US006771270B1

(12) United States Patent
Kassoff

(10) Patent No.: US 6,771,270 B1
(45) Date of Patent: Aug. 3, 2004

(54) GRAPHICS MEMORY SYSTEM THAT UTILIZES A VARIABLE WIDTH, STALL-FREE OBJECT BUILDER FOR COALESCING AND ALIGNING READ DATA

(75) Inventor: Jason Kassoff, Stanford, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 297 days.

(21) Appl. No.: 09/697,655

(22) Filed: Oct. 26, 2000

(51) Int. Cl.[7] ..... G09G 5/39
(52) U.S. Cl. ..... 345/532; 345/506
(58) Field of Search ..... 345/501–506, 345/519–520, 522, 530–574

(56) References Cited

U.S. PATENT DOCUMENTS 5,937,204 A * 8/1999 Schinnerer ..... 395/821
6,072,506 A * 6/2000 Schneider ..... 345/533
6,222,563 B1 * 4/2001 Katsura et al. ..... 345/542
6,247,084 B1 * 6/2001 Apostol et al. ..... 710/108
6,356,497 B1 * 3/2002 Puar et al. ..... 365/226
6,356,506 B1 * 3/2002 Ryan ..... 365/233
6,624,813 B1 * 9/2003 Wang ..... 345/441
6,640,292 B1 * 10/2003 Barth et al. ..... 711/168

OTHER PUBLICATIONS

Lin, Wai–Sum et al, Adaptive Parallel Rendering on Multiprocessors and Workstation Clusters, IEEE, Dec., 1999.*

* cited by examiner

*Primary Examiner*—Kee M. Tung

(57) ABSTRACT

The present invention provides a variable-width object builder for use in a graphics memory system of a computer graphics display system. The ratio of tile size to object size is variable. The tile size to object size ratio for the object builder can be 1:1 or greater. The frame buffer controller of the graphics memory system preferably comprises three memory controllers. The object builder preferably outputs either two 32-bit words or two 24-bit words. The object builder preferably utilizes a general purpose object building algorithm that eliminates stalls in the incoming stage of the object builder, thereby eliminating the potential for wasted states at the output of the object builder. A side effect of reducing the complexity of the object building algorithm is that a variety of tile and object sizes can be accommodated. The ratio of tile size to object size can range from 1 to 2 without any significant change in architecture, and higher ratios can be accommodated by adding additional backup registers.

38 Claims, 11 Drawing Sheets

GRAPHICS MEMORY SYSTEM THAT UTILIZES A VARIABLE WIDTH, STALL-FREE OBJECT BUILDER FOR COALESCING AND ALIGNING READ DATA

TECHNICAL FIELD OF THE INVENTION

The present invention relates to a graphics memory system and, more particularly, to a graphics memory system that utilizes a variable-width, stall-free object builder for coalescing and aligning read data received from multiple memory controllers.

BACKGROUND OF THE INVENTION

The role of the object builder in a frame buffer controller (FBC) is to take read data directly from the memory controller (MC) and align it to match the original read request. To avoid a bottleneck in memory bandwidth, the FBC will sometimes have a plurality of memory controllers (MCs). In this case, the object builder must also correctly order the incoming data from the memory controllers, store whatever cannot fit in the next outgoing object, and control the flow of incoming data into the object controller.

In a known graphics memory system, the object builder stalled incoming data when certain conditions occurred in order to prevent data being processed in the completion building stage of the object builder from being overwritten. This stall was seen at the output of the object builder and resulted in a wasted state. The known graphics memory system utilized many special case states to inform the object builder of the composition of the incoming data. For example, a special case state was used to inform the object builder of the condition where the incoming tile completed a partial object and contained another whole object. This would cause the object builder to stall the incoming tile in order to prevent data in the completion building stage from being overwritten. The use of these special case states necessitated a relatively complicated algorithm for the object builder algorithm.

Accordingly, a need exists for an object builder that utilizes a relatively simple, general algorithm for object building and that eliminates unnecessary stalls from occurring in the incoming object builder pipeline. A need also exists for an object builder that accomplishes these objectives and which easily accommodates various sizes of tiles and objects.

SUMMARY OF THE INVENTION

The present invention provides a variable-width object builder for use in a graphics memory system of a computer graphics display system. The tile size to object size ratio for the object builder is variable and can be 1:1 or greater.

In accordance with the preferred embodiment of the present invention, the frame buffer controller of the graphics memory system preferably comprises three memory controllers. The memory controllers each output 32-bit words to the object builder. Therefore, the object builder preferably has a 96-bit incoming stage. The object builder preferably outputs either two 32-bit words or two 24-bit words onto a 64-bit wide internal read-back bus.

The object builder preferably utilizes a general purpose object building algorithm that eliminates stalls in the incoming stage of the object builder, thereby eliminating the potential for wasted states at the output of the object builder. A side effect of reducing the complexity of the object building algorithm is that a variety of tile and object sizes can be accommodated. The ratio of tile size to object size can range from 1 to 2 without requiring any significant change in architecture, and higher ratios can be accommodated by adding additional backup registers.

Other features and advantages of the present invention will become apparent from the following discussion, drawings and claims.

DETAILED DESCRIPTION OF THE INVENTION

Figure 1:
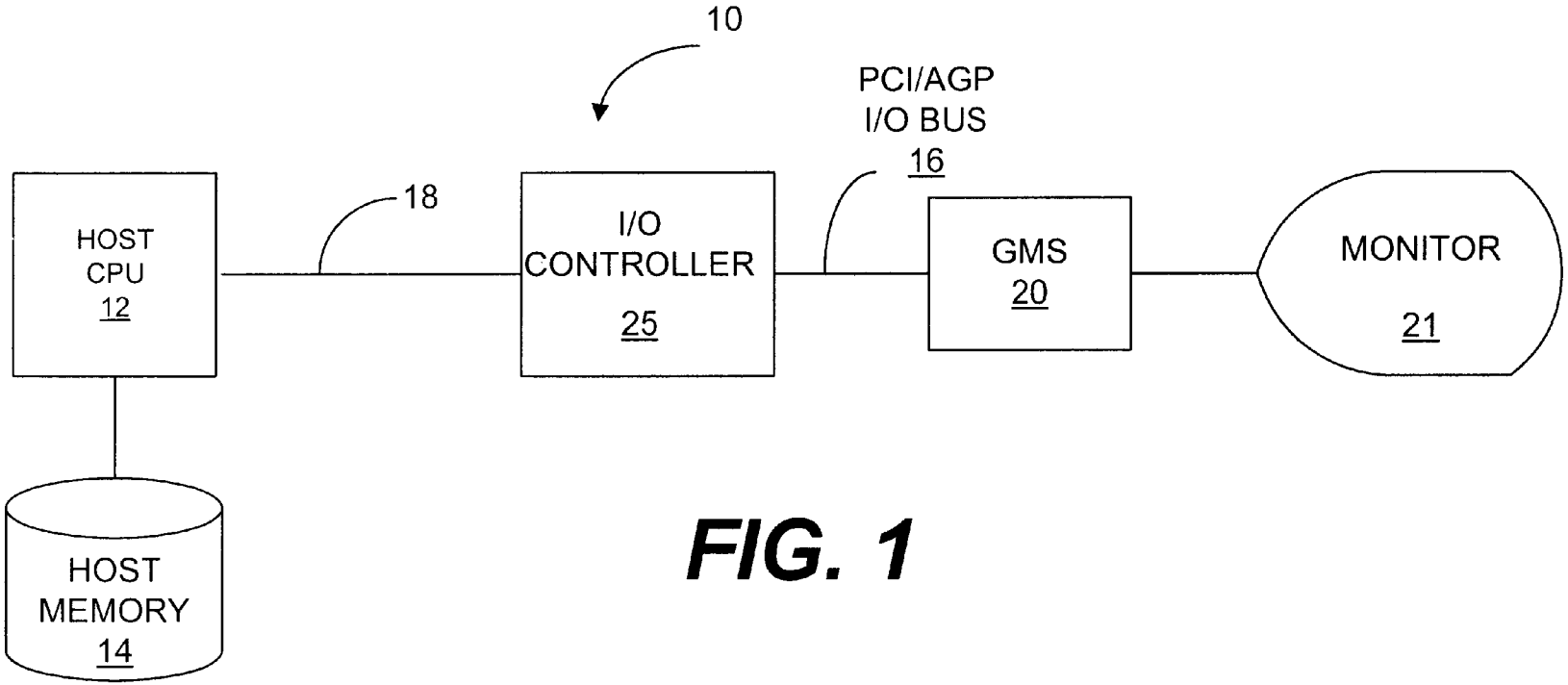
FIG. 1 is a block diagram of a computer graphics display system incorporating the graphics memory system of the present invention.

FIG. 1 is a block diagram of the computer graphics display system 10 of the present invention, which comprises the object builder of the present invention. The computer graphics display system 10 comprises a host CPU 12, a host memory device 14, a local bus 18, an input/output (I/O) controller device 25, an advanced graphics port/peripheral component interconnect (AGP/PCI) interface bus 16, a graphics memory system 20, and a monitor 21 for displaying graphics information output from the graphics memory system 20.

The host CPU 12 processes input received from the console (not shown) of the computer graphics display system 10 and outputs commands and data over the local bus 18 to the U/O interface controller 25. The I/O interface controller 25 formats the commands and data utilizing the protocols of the PCI/AGP interface bus 16. The information received over the PCI/AGP interface bus 16 is input to the graphics memory system (GMS) 20. The graphics memory system 20 then processes this information and causes graphics images to be displayed on the monitor 21. The object builder of the present invention is comprised in the graphics memory system 20 and is discussed below in detail with reference to FIGS. 3–8.

Figure 2:
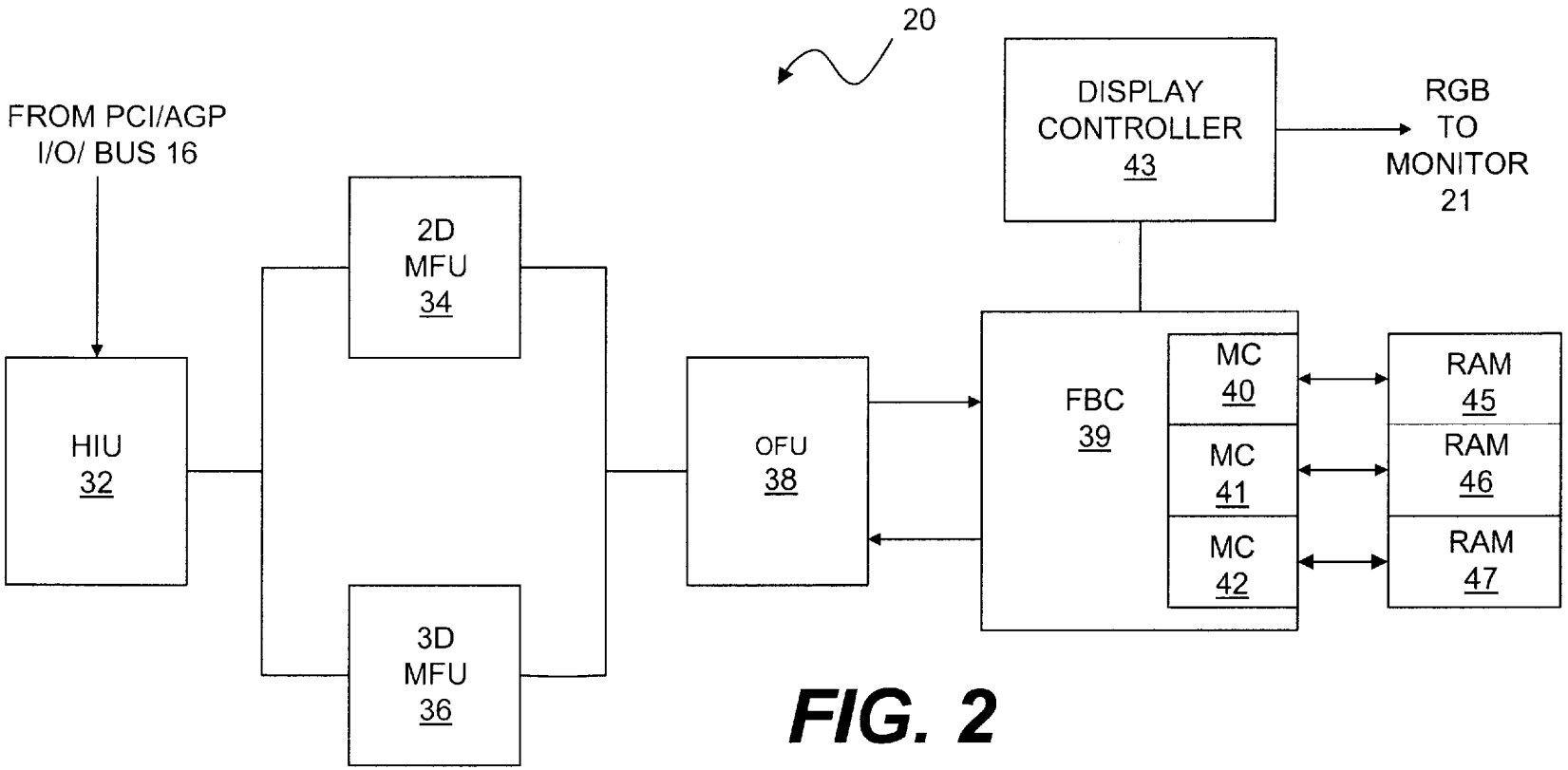
FIG. 2 is a block diagram of the graphics memory system of the computer graphics display system shown in FIG. 1.

FIG. 2 is a block diagram of the graphics memory system 20 of the present invention in accordance with the preferred embodiment. The host interface unit (HIU) 32, the 2D and 3D macro-function units (MFUs) 34, 36, the object function unit (OFU) 25 38, the frame buffer controller (FBC) 39 and the display controller 43 of the graphics memory systems 20 are typical components in graphics display systems. Therefore, only a cursory explanation of the functions of these components will be provided herein since persons skilled in the art will understand the types of operations that are performed by these components.

The host interface unit 32 fetches command data packets and texture maps from the host memory 14 via the PCI/AGP bus 16. The host interface unit 32 then provides graphics 2D information to the 2D macro-function unit 34 and 3D information to the 3D macro-function unit 36. The 2D macro-function unit 34 generates 2D vectors, text and rectangle spans. The 3D macro-function unit 36 performs triangle setup, 3D rasterization, and texture mapping.

The output from the 2D and 3D macro-function units 34 and 36 is received by the object function unit 38. The object function unit 38 performs rectangle clipping, patterning, frame buffer-to-frame buffer block transfers and rectangle span fills. The output of the object function unit 38 is received by the frame buffer controller (FBC) 39. The frame buffer controller 39 dispatches requests to the memory controllers (MC0, MC1, and MC2) 40, 41 and 42 to cause the memory controllers 40, 41 and 42 to write and read pixel colors and Z coordinates to and from RAMs 45, 46 and 47. The frame buffer controller 39 also fetches display information which is sent to a display controller (not shown). The display controller (not shown) receives the display information and converts it into red, green and blue (RGB) analog data and sends it to the display monitor 21.

Figure 3:
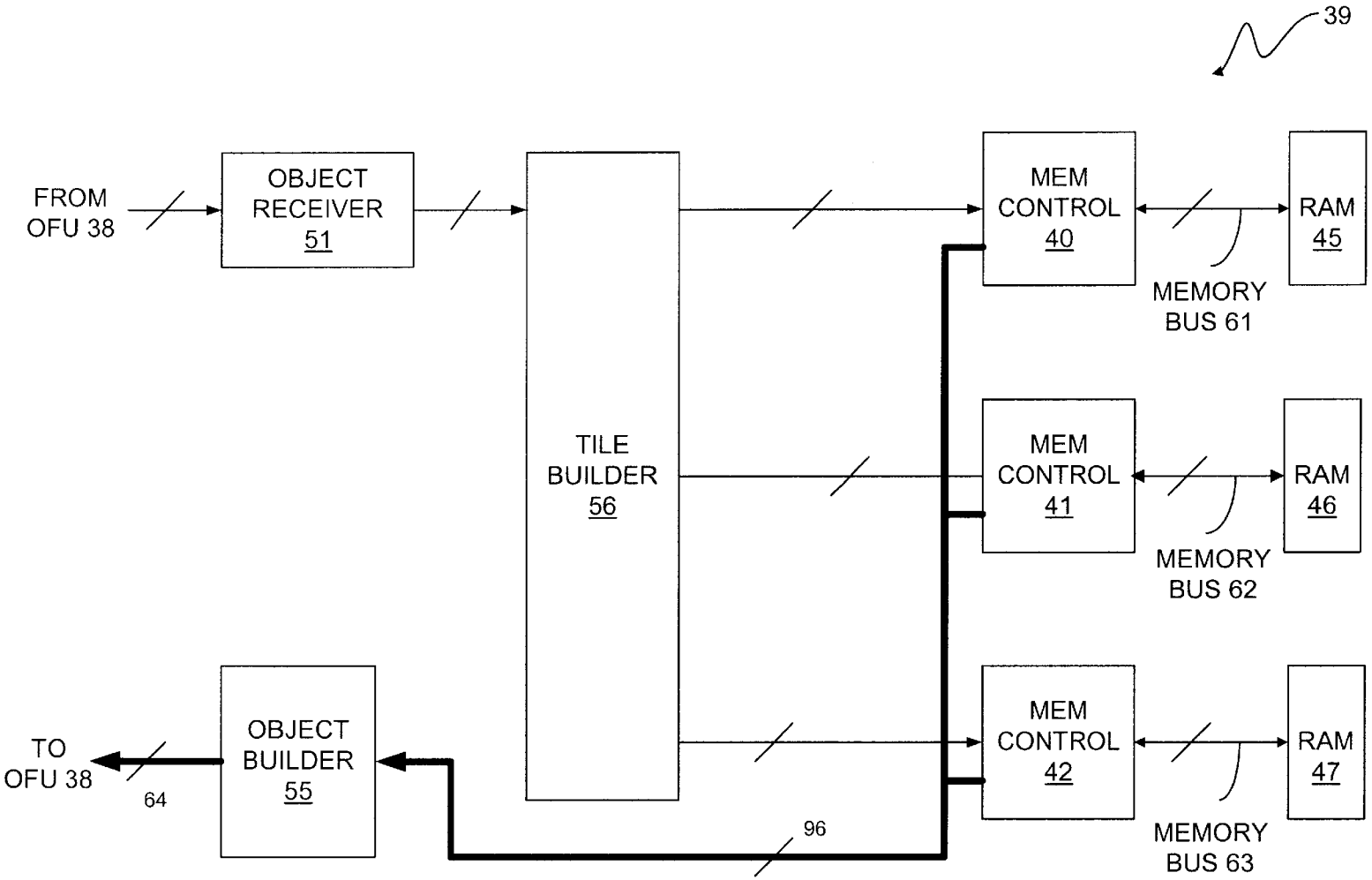
FIG. 3 is a block diagram of the frame buffer controller of the graphics memory system shown in FIG. 2 in accordance with the preferred embodiment of the present invention.

FIG. 3 is a block diagram of the frame buffer controller 39 of the present invention in accordance with the preferred embodiment. The object receiver 51 and the object builder 55 are both in communication with the object function unit 38 (FIG. 2). The object builder 55 receives pixel data from the memory controllers 41, 42 and 43 read out of RAM 45, RAM 46 and RAM 47, respectively, and provides the read data to the object function unit 38. In accordance with the preferred embodiment, the object builder 55 receives 32-bit words from each of the memory controllers 41, 42 and 43, which results in a 96-bit tile. The object builder 55 reorders and reformats the data into either two 32 bit words or two 24-bit words, which are then output onto a 64-bit internal readback bus. Therefore, in accordance with the preferred embodiment, the ratio of tile size to object size is 3:2. However, as discussed below in more detail, this ratio can range from 1:1 to 2:1. Furthermore, even higher can be achieved by adding additional backup registers for storing incoming tile data. The manner in which these ratios can be achieved will be understood by those skilled in the art from the discussion provided herein.

The object receiver 51 receives X, Y and Z screen coordinates and Y, U, V or R, G, B color data from the object function unit 38, converts the color data into R, G, B format, if necessary, and provides the coordinate and R, G, B color data to the tile builder 56. The tile builder 56 builds tiles, which are 32-bit words of Z coordinate data and color data. The tile builder 56 outputs tiles of Z data and color data along with their corresponding row and column addresses to the memory controllers 40, 41 and 42. Each of the memory controllers 40, 41 and 42 receives Z row and column addresses, pixel row and column addresses, and pixel color data. Each of the RAM memory elements 45, 46 and 47 comprises an image buffer storage area (not shown) and a Z buffer storage area (not shown). The pixel color data is stored in the image buffer storage area and the Z coordinate data is stored in the Z buffer storage area. The RAM memory devices 45, 46 and 47 communicate with the memory controllers 40, 41 and 42 via memory buses 61, 62 and 63, respectively.

As stated above, the role of the object builder 55 is to take read-data directly from the memory controllers 40, 41 and 42 and align it to match the original read request. By utilizing multiple memory controllers, a bottleneck in memory bandwidth is prevented from occurring. The object builder 55 must also correctly order the incoming data, store whatever cannot fit in the next outgoing object, and control the flow of incoming data. The manner in which the object builder 55 of the present invention performs its functions will now be described. In order to demonstrate certain advantages of the object builder 55 of the present invention over previous designs, the manner in which an object builder of a previous design functions will be described and compared with the object builder of the present invention.

Figure 4:
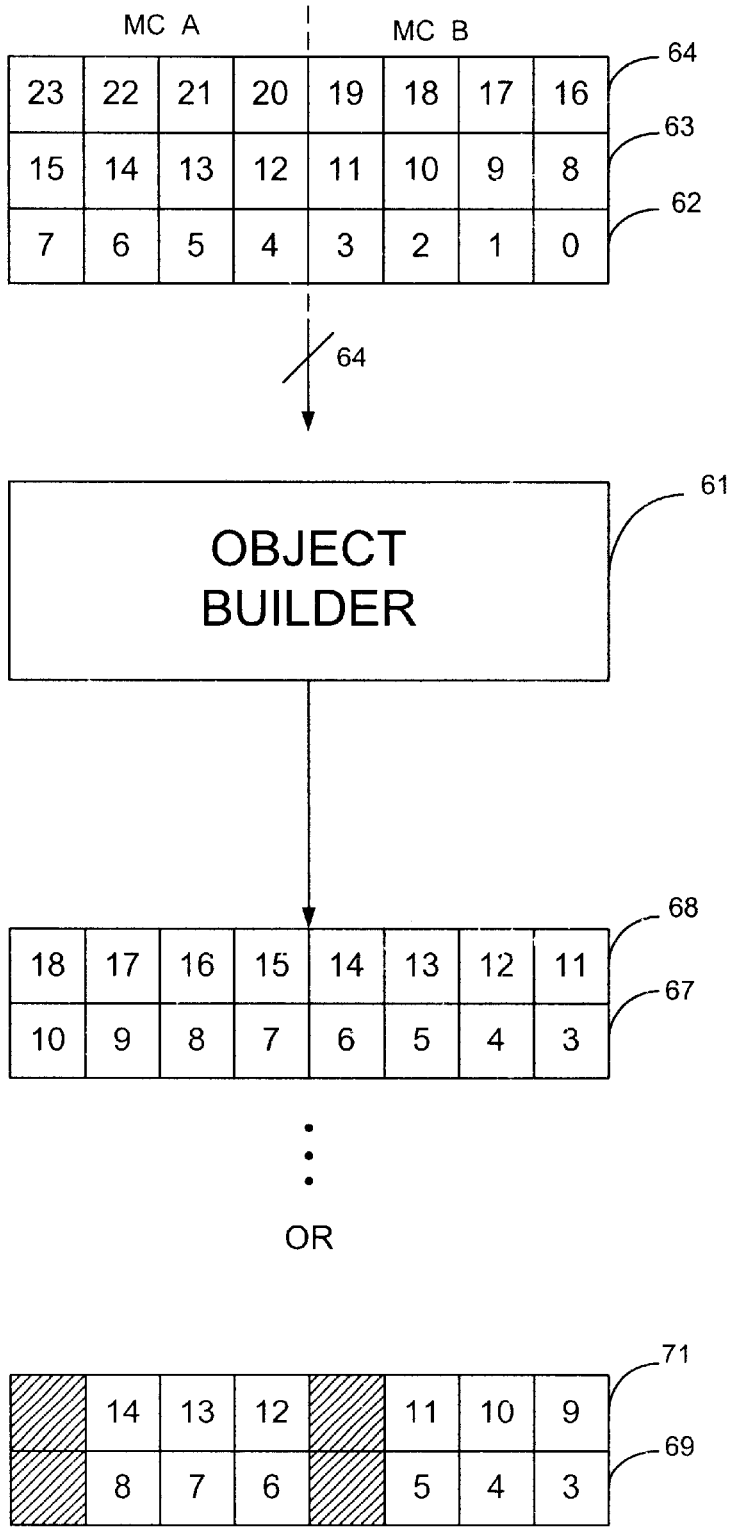
FIG. 4 is a block diagram of an object builder of a known graphics memory system that receives 64-bit tiles at the input of the object builder and produces either 2×24 bit or 2×32 bit objects at the output of the object builder.
Figure 5:
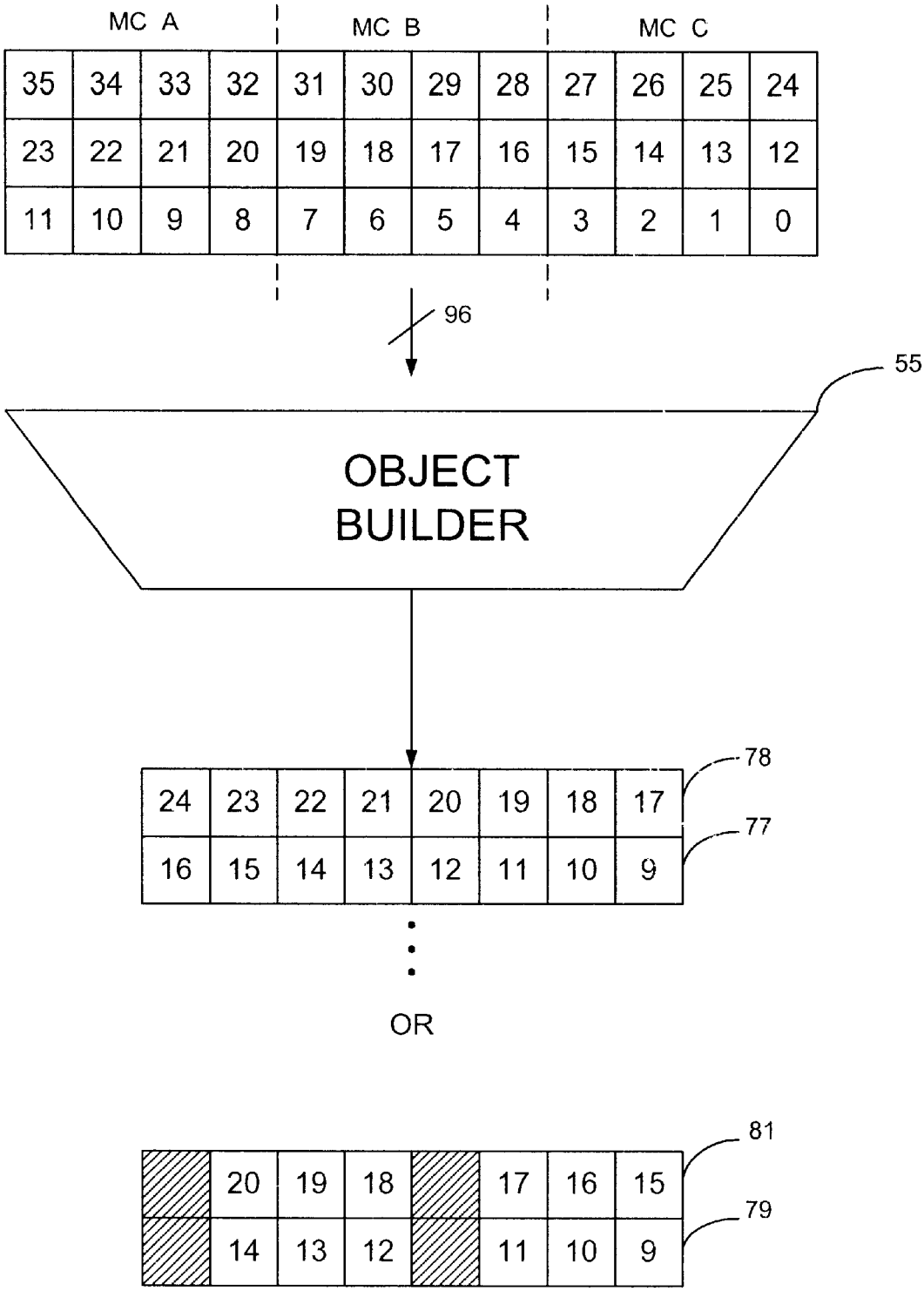
FIG. 5 is a block diagram of the object builder of the present invention illustrating the case where the object builder receives 96-bit tiles at its input and produces either 2×24 bit or 2×32 bit objects.

FIGS. 4 and 5 illustrate the flow of data through an object builder 61 of a previous design and through the object builder 55 of the present invention, respectively. The object builder 61 of the prior design receives a 32-bit word from memory controller A and a 32-bit word from memory controller B. Each of the rows 62, 63 and 64 represents 64 bits of data. The object builder 61 outputs 64-bit words onto the 64-bit internal readback bus of the graphics memory system of the prior design. Each of the rows 67 and 68 represents a 64-bit word. Each block within the rows represents a byte of data. The object builder 61 of the prior design was capable of outputting either two 24-bit objects or two 32-bit objects. Rows 67 and 68 each represent two-32-bit objects being output onto the internal read-back bus. Rows 69 and 71 each represent two 24-bit words being output onto the internal read-back bus. The shaded blocks represent dummy bits.

The ratio of tile size to object size for the object builder 61 of FIG. 4 is 1:1. In accordance with the present invention, the ratio of tile size to object size is variable. For exemplary purposes, the object builder 55 is shown in FIG. 5 as having a ratio of 3:2. In other words, 96-bit words are received by the object builder 55 and 64-bit words are output from the object builder 55. However, as stated above, the tile size to object size ratio for the object builder 55 of the present invention can be 1:1 or greater. The frame buffer controller 39 (FIG. 3) of the present invention preferably comprises three memory controllers, which are represented as MC A, MC B and MC C in FIG. 5.

Figure 6A:
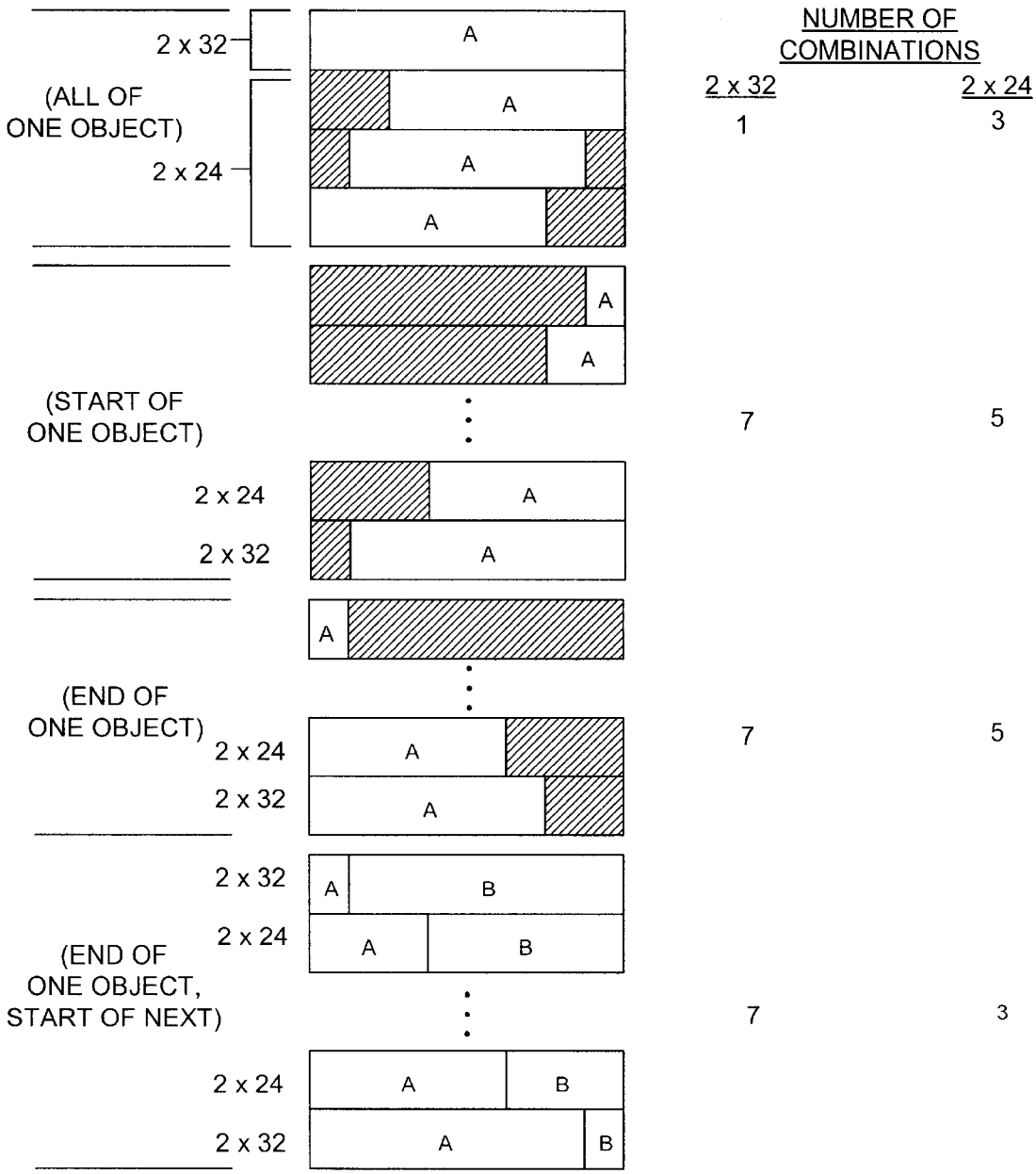
FIGS. 6A and 6B illustrate the various combinations of tiles that can be sent from the memory controllers to the object builder of FIG. 4.
Figure 6B:
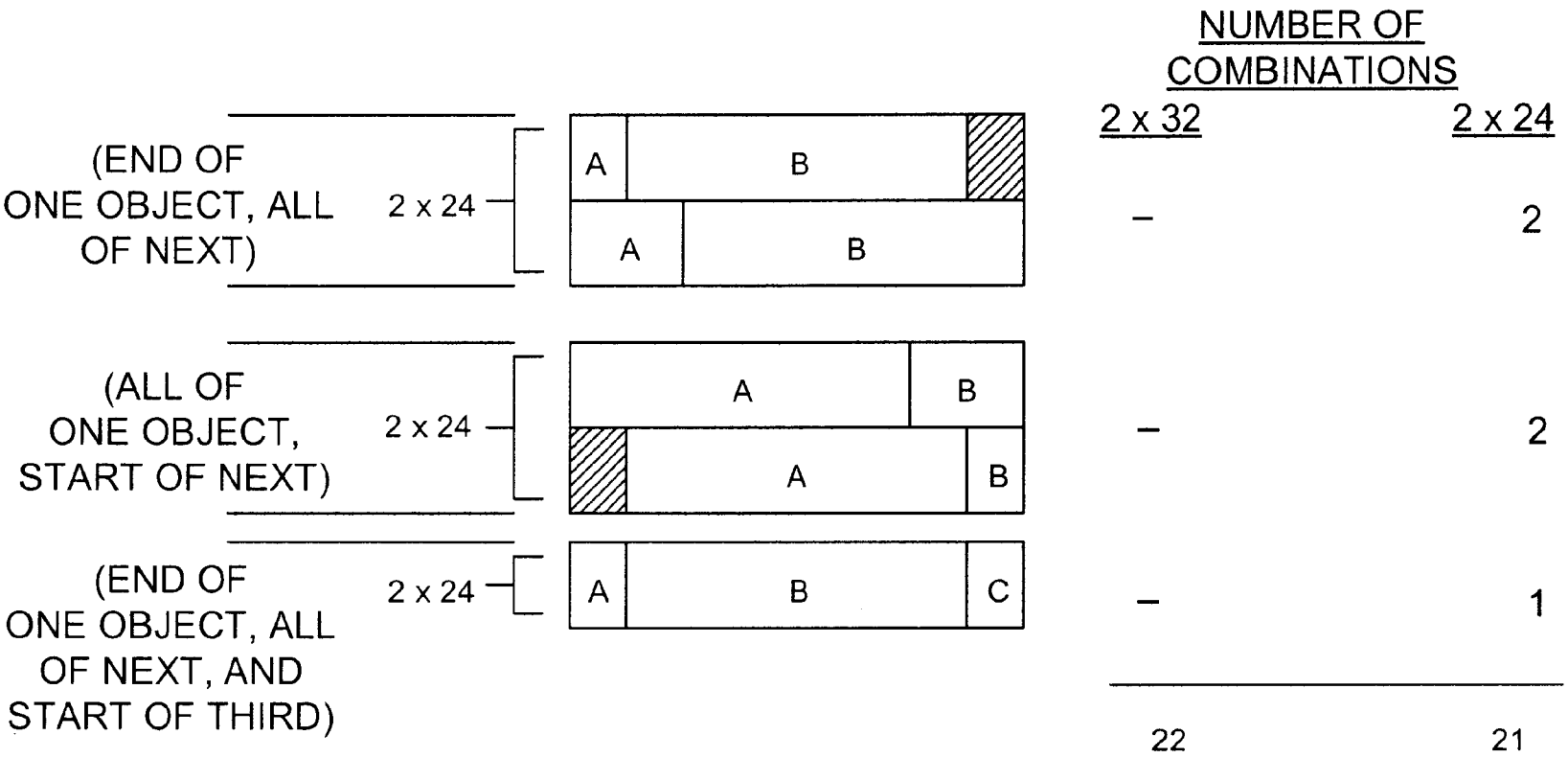

The object builder 55 outputs either two 32-bit words, as indicated by rows 77 and 78, or two 24-bit words, as indicated by rows 79 and 81. Therefore, the object builder 55 of the present invention is capable of producing objects that are identical in size to those output from the object builder 61 of the prior design shown in FIG. 4. However, as stated above the object builder 55 eliminates stalls that resulted in wasted states in the object builder of the prior design by utilizing a general purpose algorithm that eliminates the need for special case states. FIGS. 6A and 6B illustrate the various object combinations that were used with the object builder 61 of the prior design for both 2×32-bit objects and 2×24 bit objects. As demonstrated by the drawings, a total of 43 different object combinations were possible.

Figure 7A:
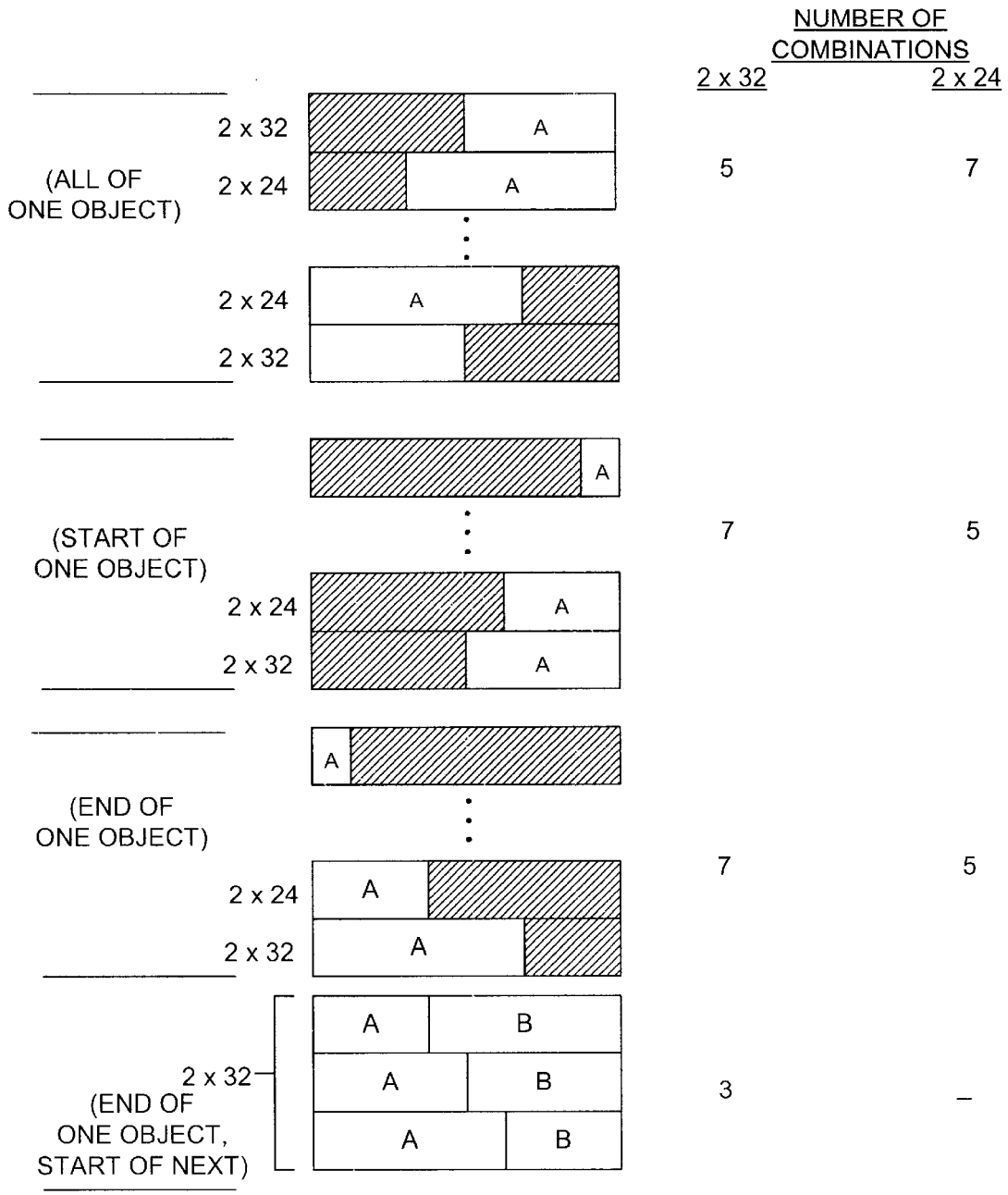
FIGS. 7A and 7B illustrate the various combinations of tiles that can be sent from the memory controllers to the object builder of the present invention shown in FIG. 5.
Figure 7B:
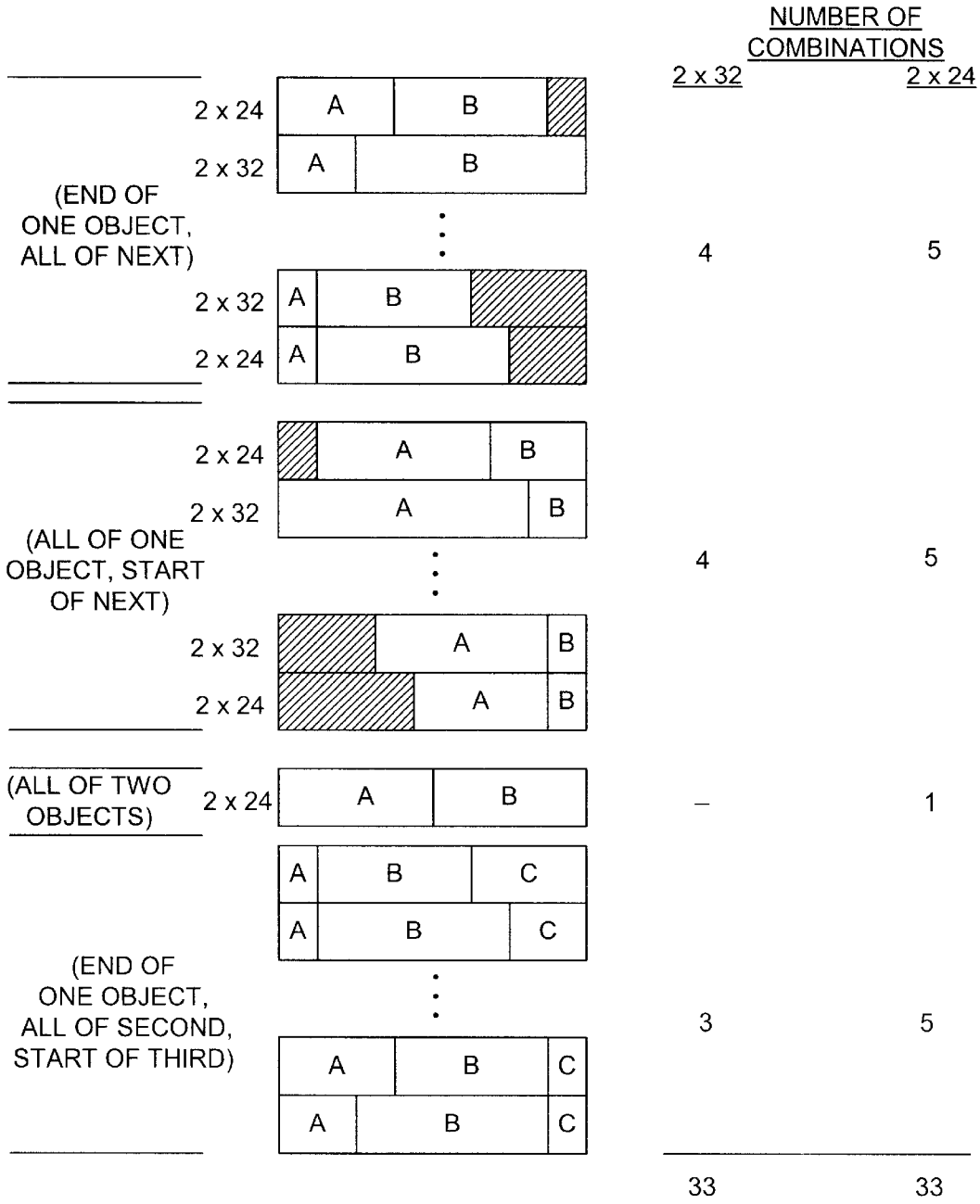

In contrast, the total number of object combinations possible with the object builder 55 in accordance with the preferred embodiment is 66, as illustrated by the object combinations shown in FIGS. 7A and 7B. Therefore, the object builder in accordance with this embodiment must be capable of handling approximately 50% more combinations than the object builder 61 of the prior design. Consequently, special case states utilized in the prior design are less practical for use with the object builder of the present invention when higher tile size to object size ratios are capable of being implemented. Thus, the object builder 55 of the present invention preferably uses a more general algorithm, which eliminates the wasted states that occurred in the object builder of the prior design.

Figure 8:
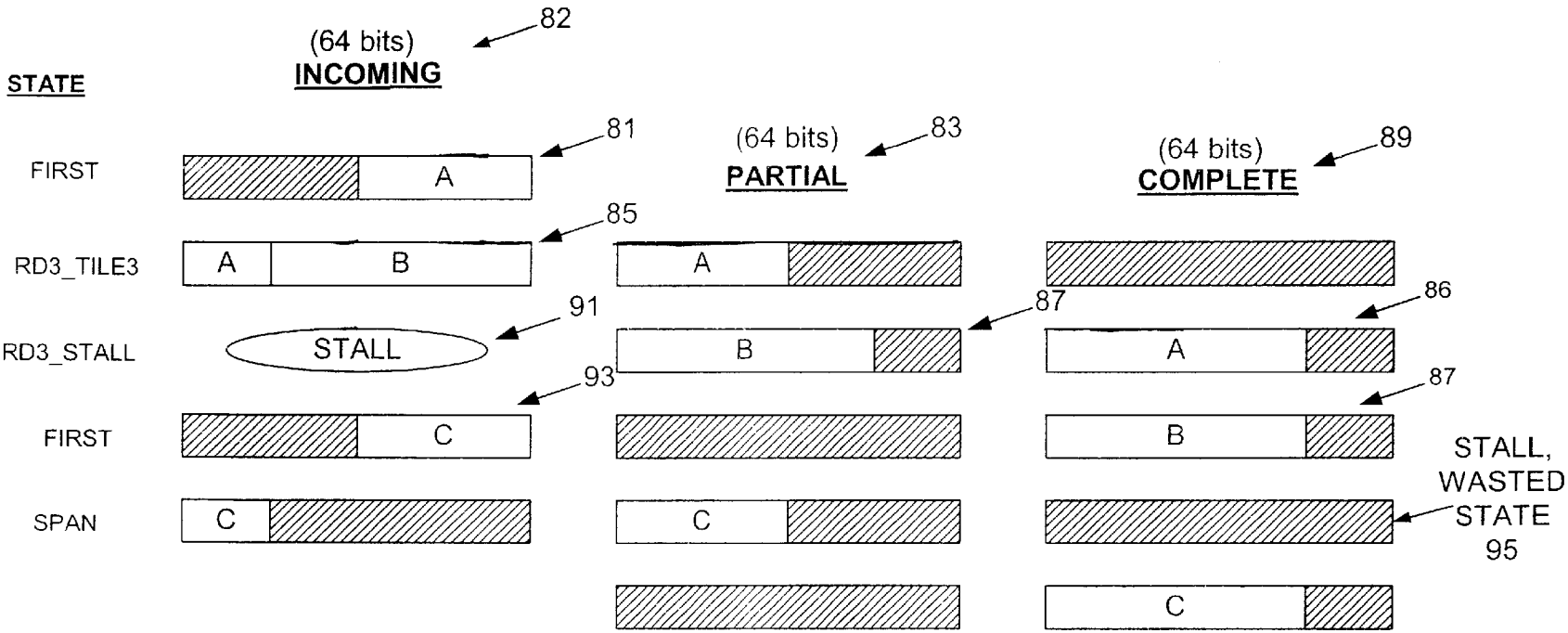
FIG. 8 is a diagram illustrating the manner in which the object builder shown in FIG. 4 produces a stall at its input, which results in a wasted state at the output.

Prior to discussing the manner in which the present invention eliminates stalls that are capable of producing wasted states, the manner in which the prior design produced wasted states will be described with respect to FIG. 8. Both the object builder 55 of the present invention and the object builder of the prior design utilize a partial and a completion building stage. The manner in which these stages operate can be seen in FIG. 8. In a first state, an incoming word 81 is received in the incoming stage 82. In the next state, "RD_TILE3", the word 81 has been rotated in the partial building stage 83 and a second word 85 has been received in the incoming stage. In the next state, "RD3_STALL", all of object A 86 has been placed in the completion building stage and object B 87 is in the partial building stage. If a stall in the incoming stage is not produced at this point, it would be possible for object B 87 to be overwritten when it is in the completion building stage 89.

In the prior design, whenever the incoming tile contained a single object, the object would bypass the partial building stage 83 and be input into the completion building stage 89. Therefore, if a stall did not occur in the state following the state in which the tile received in the incoming stage contained a whole object and completed a partial object, the single object received in the incoming stage in the next state would be sent to the completion building stage 87 before that stage was empty. For example, if the stall 91 shown in FIG. 8 did not occur, and a single object was received in the incoming stage at state "RD#_STALL" 91, object B 87 would be overwritten in the completion building stage 89. Therefore, the object builder of the prior design created a stall in the input stage whenever the tile completed a partial object and contained a whole object.

The stall was unnecessary except in the situation described in the above example, i.e., when the next tile contains a single object. In this case, the object builder was required to wait an extra state for the completion building stage 89 stage to become empty. In this case, the "stall" was not seen at the output of the object builder anyway. However, in all other cases, the stall generated in the incoming stage was seen at the output of the object builder as a wasted state. This is shown in FIG. 8. Even though the incoming tile 93 following the stall did not contain a single object, but rather contained part of object C, the stall 91 occurred, which resulted in the wasted state 95 at the output of the object builder.

Figure 9:
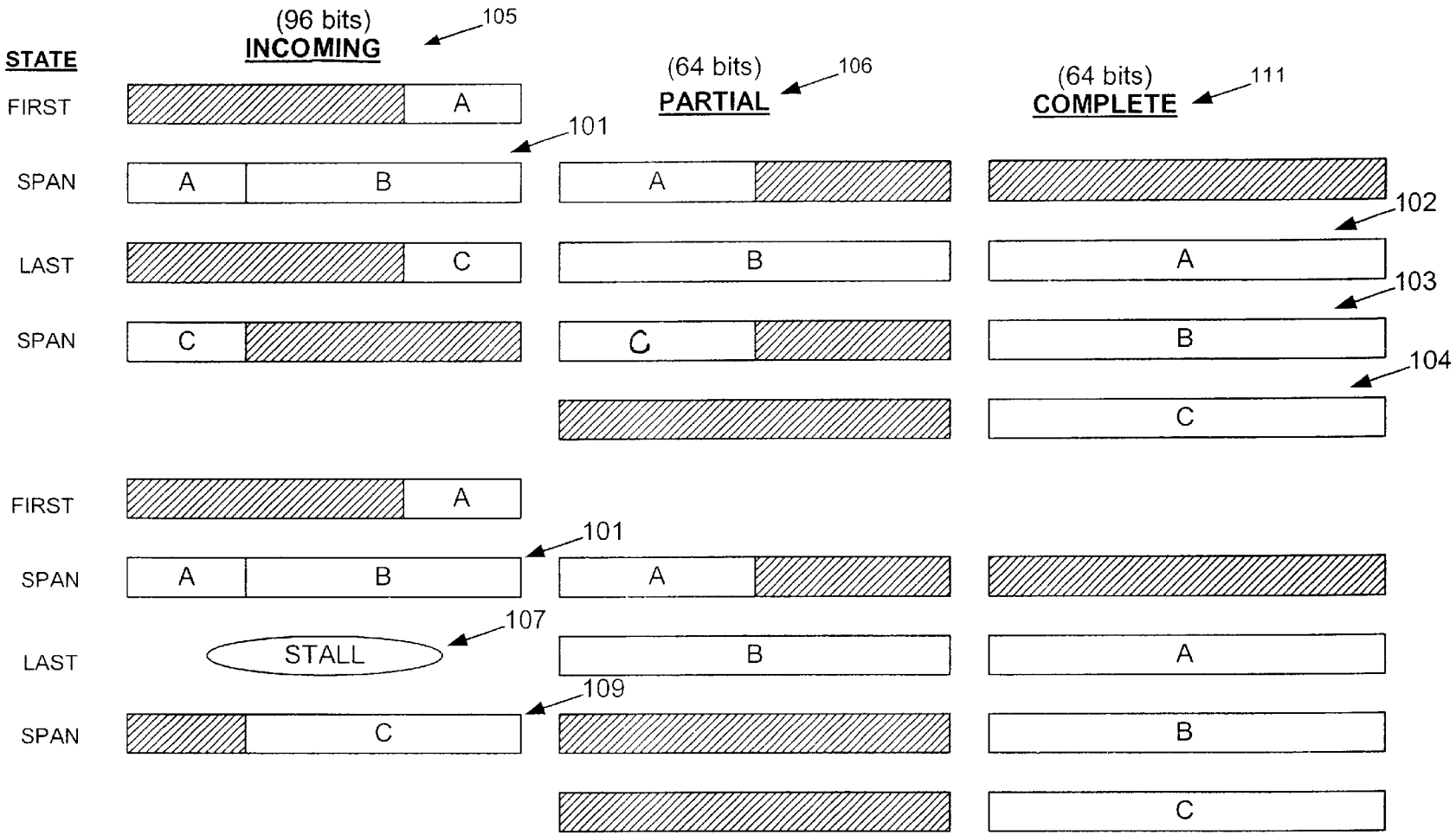
FIG. 9 illustrates the manner in which the object builder of the present invention shown in FIG. 5 eliminates a stall at its input in most situations and prevents a stall at its input from being seen at its output in the situation where a stall at its input does occur.

The object builder 55 of the present invention combines the control for the states called "FIRST" and "LAST" so that this stall is eliminated whenever possible. The diagram of FIG. 9 shows how the stall is eliminated in most cases and how single-object cases cause a pseudo-stall that does not result in a wasted state at the output of the object builder 55. As shown at the top of FIG. 9, although the tile 101 completes object A and contains all of object B, no stall occurs at state "LAST". Consequently, no wasted state is seen at the output of the object builder, as indicated by objects A, B and C 102, 103 and 104 being in the completion building stage 111 in sequential states.

Toward the bottom of FIG. 9, the stall 107 occurs in the state "LAST". The stall 107 occurs because the tile 101 completes an object (object A) and contains all of another object (object B) AND the next incoming tile contains a single object (object C) 109. In this case, the stall occurs, but the single object 109 is sent to the completion building stage 111, bypassing the partial building stage 106. Thus, the stall 107 does not result in a wasted state at the output of the object builder, as indicated by the order of objects A, B an C in the completion stage 111.

In addition to eliminating stalls, the object builder of the present invention has reduced complexity. As stated above, the object builder of the prior design included special-case states for the 2×24, or region depth 3 (RD#), objects. The object builder of the prior design would first build 2×32 objects, then use a second stage to split these into 2×24 objects and store the leftover to be combined with the next 2×32 objects. The object builder of the present invention is simpler in that it eliminates the complexity and additional storage requirements of the prior design. The state machine utilized by the object builder of the present invention has only three states, "FIRST", "SPAN" and "LAST" and two of them (FIRST and LAST) share almost all of the same control, differing only in the aforementioned single-object case described earlier. The 2×24 case is built using the same states and the same data path as the 2×32 case.

A side effect of reducing the algorithmic complexity is that the design of the present invention can easily be adapted to a variety of tile and object sizes. As stated above, the ratio of tile size to object size can range from 1 to 2 without any significant change in architecture, and higher ratios can be accommodated by adding additional backup registers.

It should be noted that the present invention has been described with respect to the preferred embodiments of the present invention. It will be understood by those skilled in the art that modifications can be made to the embodiments of the present invention discussed herein and that any such modifications are within the scope of the present invention. For example, although the width of the incoming stage of the object builder and of the internal read-back bus have been discussed as being 96 bits and 64 bits, respectively, those skilled in the art will understand that the present invention is not limited to these widths. Also, although the features of the present invention have been discussed with reference to hardware, those skilled in the art will understand that hardware implementations can instead be implemented in a combination of software and hardware if desired.

What is claimed is:

1. An object builder of a graphics memory system, the object builder comprising:

an incoming stage, the incoming stage receiving an N-bit word to be processed by the object builder, the N-bit word being sent over a first bus from one or more memory controllers to the incoming stage;

a partial building stage in communication with the incoming stage; and a completion building stage in communication with the partial building stage, the completion building stage outputting an M-bit word onto a second bus, wherein a ratio of N to M is greater than 1, wherein said N-bit word received by said incoming stage comprises data read from frame buffer memory in response to a read request, and wherein said stages of said object builder operate to align said data to match said read request.

2. The object builder of claim 1, wherein the N-bit word corresponds to object data sent by three memory controllers over the first bus to the object builder, and wherein the ratio of N to M is 3:2.

3. The object builder of claim 1, wherein the N-bit word corresponds to object data sent by three memory controllers over the first bus to the object builder, and wherein the ratio of N to M is 2.

4. The object builder of claim 1, wherein the N-bit word corresponds to object data, the object data comprising bits that complete a previously sent partial object and bits that define an entire object, the previously sent partial object being received at the incoming stage in a "FIRST" state, wherein the object data that completes the previously sent partial object and defines an entire object is received at the incoming stage in a "SPAN" state that immediately follows the "FIRST" state, and wherein in a "LAST" state that immediately follows the "SPAN" state, object data is received at the incoming stage.

5. The object builder of claim 1, wherein the N-bit word corresponds to object data, the object data comprising bits that complete a previously sent partial object and bits that define an entire object, the previously sent partial object being received at the incoming stage in a "FIRST" state, wherein the object data that completes the previously sent partial object and defines an entire object is received at the incoming stage in a "SPAN" state that immediately follows the "FIRST" state, and wherein in a "LAST" state that immediately follows the "SPAN" state, a stall occurs at the incoming stage.

6. The object builder of claim 5, wherein the stall only occurs at the incoming stage when object data received at the incoming stage in a second "SPAN" state immediately following the "Last" state comprises a single object.

7. The object builder of claim 1, wherein the N-bit word received by the incoming stage comprises data read from frame buffer memory by the one or more memory controllers.

8. The object builder of claim 1, wherein the N-bit word comprises data transmitted from each of a plurality of memory controllers.

9. The object builder of claim 1, wherein the N-bit word comprises a first set of bits that complete a previously sent partial object and a second set of bits that define another object.

10. The object builder of claim 9, wherein the object builder is configured to move the second set of bits from the incoming stage to the partial building stage and to move the first set of bits from the incoming stage to the completion building stage thereby bypassing the partial building stage with the first set of bits.

11. The object builder of claim 9, wherein the second set of bits is stored in the partial building stage and the first set of bits is stored in the completion building stage during a first state, and wherein the second set of bits is stored in the completion building stage during a second state that immediately follows the first state.

12. The object builder of claim 9, wherein the N-bit word is stored in the incoming stage during a first state, the object builder configured to determine whether to stall the incoming stage during a second state, which immediately follows the first state, based on whether a word following the N-bit word comprises data defining a complete object.

13. The object builder of claim 12, wherein the word following the N-bit word is transmitted over the first bus from the one or more memory controllers.

14. The object builder of claim 12, wherein, if the complete object is defined by the data, the object builder is configured to stall the incoming stage during the second state and to bypass the partial building stage with the complete object.

15. An object builder of a graphics memory system, the object builder comprising:

an incoming stage, the incoming stage receiving an N-bit word to be processed by the object builder, the N-bit word being sent over a first bus from one or more memory controllers to the incoming stage;

a partial building stage in communication with the incoming stage; and a completion building stage in communication with the partial building stage, the completion building stage outputting an M-bit word onto a second bus, wherein a ratio of N to M is greater than or equal to 1, and wherein the N-bit word corresponds to object data, the object data comprising bits that complete a previously sent partial object and bits that define an entire object, the previously sent partial object being received at the incoming stage in a "FIRST" state, and wherein the object data that completes the previously sent partial object and defines an entire object is received at the incoming stage in a "SPAN" state that immediately follows the "FIRST" state, and wherein in a "LAST" state that immediately follows the "SPAN" state, object data is received at the incoming stage.

16. The object builder of claim 15, wherein the N-bit word corresponds to object data sent by three memory controllers over the first bus to the object builder, and wherein the ratio of N to M is 3:2.

17. The object builder of claim 15, wherein the N-bit word corresponds to object data sent by three memory controllers over the first bus to the object builder, and wherein the ratio of N to M is 2.

18. A computer graphics display system comprising a graphics memory system, the graphics memory system comprising:

a plurality of memory controllers; and an object builder, the object builder comprising an incoming stage, a partial building stage and a completion building stage, the incoming stage receiving an N-bit word to be processed by the object builder, the N-bit word being sent over a first bus from the memory controllers to the incoming stage, the partial building stage in communication with the incoming stage, the completion building stage in communication with the partial building stage, the completion building stage outputting an M-bit word onto a second bus, wherein a ratio of N to M is greater than 1.

19. The computer graphics display system of claim 18, wherein the N-bit word corresponds to object data sent by three memory controllers over the first bus to the object builder, and wherein the ratio of N to M is 3:2.

20. The computer graphics display system of claim 18, wherein the N-bit word corresponds to object data sent by three memory controllers over the first bus to the object builder, and wherein the ratio of N to M is 2.

21. The computer graphics display system of claim 18, wherein the N-bit word corresponds to object data, the object data comprising bits that complete a previously sent partial object and bits that define an entire object, the previously sent partial object being received at the incoming stage in a "FIRST" state, wherein the object data that completes the previously sent partial object and defines an entire object is received at the incoming stage in a "SPAN" state that immediately follows the "FIRST" state, and wherein in a "LAST" state that immediately follows the "SPAN" state, object data is received at the incoming stage.

22. The computer graphics display system of claim 18, wherein the N-bit word corresponds to object data, the object data comprising bits that complete a previously sent partial object and bits that define an entire object, the previously sent partial object being received at the incoming stage in a "FIRST" state, wherein the object data that completes the previously sent partial object and defines an entire object is received at the incoming stage in a "SPAN" state that immediately follows the "FIRST" state, and wherein in a "LAST" state that immediately follows the "SPAN" state, a stall occurs at the incoming stage.

23. The computer graphics display system of claim 22, wherein the stall only occurs at the incoming stage when object data received at the incoming stage in a second "SPAN" state immediately following the "Last" state comprises a single object.

24. The computer graphics display system of claim 18, wherein each of the memory controllers transmits a different portion of the N-bit word over the first bus.

25. A method for building objects in an object builder of a graphics memory system, the method comprising:

in a "FIRST" state, receiving a first N-bit word to be processed by the object builder at an incoming stage of the object builder, the first N-bit word transmitted to the incoming stage from frame buffer memory;

in a "SPAN" state, receiving a second N-bit word at the incoming stage and a first portion of the first N-bit word in a partial building stage of the object builder, the second N-bit word transmitted to the incoming stage from frame buffer memory; and in a "LAST" state, combining the first portion of the first N-bit word with a first portion of the second N-bit word in a completion building stage to form a first object, and receiving a second portion of the second N-bit word in the partial building stage, and wherein the first object is an M-bit word, and wherein a ratio of N to M is greater than 1.

26. The method of claim 25, wherein, in the "LAST" state, a third N-bit word to be processed by the object builder is received at the incoming stage unless the third N-bit word contains a single object, wherein if the third N-bit word contains a single object, a stall occurs at the incoming stage in the "LAST" state.

27. The method of claim 25, further comprising:

determining whether or not the third N-bit word contains a single object prior to receiving the third N-bit word at the incoming stage, wherein if a determination is made that the third N-bit word contains a single object, a stall is created at the incoming stage in the "LAST" state and the third N-bit word is not received in the incoming stage.

28. The method of claim 25, wherein the first N-bit word is transmitted to the incoming stage from each of a plurality of memory controllers.

29. The method of claim 25, wherein the second portion of the second N-bit word defines a complete object, the method further comprising, in the last state, stalling the incoming stage based on a determination that an incoming N-bit word defines a complete object.

30. An object builder of a graphics memory system, the object builder comprising:

an incoming stage, the incoming stage receiving and storing, during a first state, an N-bit word to be processed by the object builder, the N-bit word being sent over a first bus from one or more memory controllers to the incoming stage and comprising data read from frame buffer memory by the one or more memory controllers, the data comprising a first set of bits that complete a previously sent partial object and a second set of bits that define another object;

a partial building stage in communication with the incoming stage; and a completion building stage in communication with the partial building stage, wherein the object builder is configured to determine whether to stall the incoming stage during a second state, which immediately follows the first state, based on whether a word following the N-bit word comprises data defining a complete object.

31. The object builder of claim 30, wherein different ones of the memory controllers transmit different portions of the N-bit word over the first bus to the object builder.

32. The object builder of claim 30, wherein the object builder is configured to move the second set of bits from the incoming stage to the partial building stage and to move the first set of bits from the incoming stage to the completion building stage thereby bypassing the partial building stage with the first set of bits.

33. The object builder of claim 30, wherein the second set of bits is stored in the partial building stage and the first set of bits is stored in the completion building stage during the second state, and wherein the second set of bits is stored in the completion building stage during a third state that immediately follows the second state.

34. The object builder of claim 30, wherein, if the complete object is defined by the data of the word that follows the N-bit word, the object builder is configured to stall the incoming stage during the second state and to bypass the partial building stage with the complete object.

35. The object builder of claim 30, wherein the object builder is configured to transmit the first set of bits from the incoming stage to the completion stage during the second state, thereby causing the first set of bits to bypass the partial building stage, and to transmit the second set of bits from the incoming stage to the partial building stage during the second state, wherein the object builder is further configured to separately output the first and second sets of bits from the completion stage during different states such that the data read from the buffer is aligned with a read request, and wherein the one or more memory controllers are configured to read the data from the frame buffer memory based on the read request.

36. The object builder of claim 30, wherein said N-bit word received by said incoming stage comprises data read from frame buffer memory in response to a read request, and wherein said stages of said object builder operate to align said data to match said read request.

37. A method for building objects in an object builder of a graphics memory system, the method comprising:

receiving, at an incoming stage, an N-bit word from one or more memory controllers, the N-bit word comprising a first set of bits that complete a previously received partial object and a second set of bits that define another object;

storing the N-bit word in the incoming stage during a first state;

storing the second set of bits in a partial building stage during a second state, which immediately follows the first state;

storing the first set of bits and the previously received partial object in a completion building stage during the second state; and stalling the incoming stage during the second state based on whether a word following the N-bit word comprises data defining a complete object.

38. The method of claim 37, further comprising moving the first set of bits from the incoming stage to the completion building stage thereby bypassing the partial building stage.

* * * * *